US007033282B1

(12) United States Patent
Flood

(10) Patent No.: US 7,033,282 B1
(45) Date of Patent: Apr. 25, 2006

(54) GOLF TRAINING DEVICE

(75) Inventor: James J. Flood, Solana Beach, CA (US)

(73) Assignee: Rockroller, LLC, Carson City, NV (US)

( * ) Notice: Subject to any disclaimer, the term of this patent is extended or adjusted under 35 U.S.C. 154(b) by 0 days.

(21) Appl. No.: 10/994,136

(22) Filed: Nov. 19, 2004

(51) Int. Cl.
*A63B 69/36* (2006.01)

(52) U.S. Cl. ..... 473/227; 473/226; 473/219; 473/276

(58) Field of Classification Search ..... 473/206, 473/212, 213, 227, 275, 276, 226, 219
See application file for complete search history.

(56) References Cited

U.S. PATENT DOCUMENTS

| | | | | |
|---|---|---|---|---|
| 2,273,416 | A | 2/1942 | Norwood | |
| 3,951,416 | A | 4/1976 | Koch et al. | |
| 4,239,228 | A | 12/1980 | Norman et al. | |
| 4,944,516 | A | 7/1990 | Bickler | |
| 5,145,179 | A | 9/1992 | Breed | |
| 5,156,401 | A | 10/1992 | Hodgkiss | |
| 5,203,568 | A * | 4/1993 | Vasquez | 473/212 |
| 5,248,146 | A * | 9/1993 | Viets et al. | 473/206 |
| 5,259,621 | A | 11/1993 | Keefer | |
| 5,465,971 | A | 11/1995 | Tischler | |
| 5,470,073 | A | 11/1995 | Vasquez | |
| 5,711,716 | A | 1/1998 | O'Brien et al. | |
| 5,902,189 | A * | 5/1999 | Schultz | 473/212 |
| 5,904,624 | A * | 5/1999 | Martinez | 473/212 |
| 6,780,119 | B1 | 8/2004 | Gankas | |
| 6,805,640 | B1 * | 10/2004 | Kim et al. | 473/226 |

* cited by examiner

*Primary Examiner*—Nini F. Legesse
(74) *Attorney, Agent, or Firm*—Blakely Sokoloff Taylor & Zafman LLP

(57) ABSTRACT

An apparatus including a transverse housing having a length sized to fit between the shoulder blades of a human; and a descending shaft coupled to and bisecting the transverse housing, the descending shaft including a length suitable to extend from the transverse housing to a shaft of a golf club when a human assumes an addressing stance and the transverse housing is engaged the biceps of the human; and a distal end having a dimension suitable to fit within a bleeder hole of a golf club grip. A method including coupling a training device to a shaft of a putter through the bleeder hole, the training device including a transverse housing and a descending shaft coupled to and bisecting the transverse housing; and engaging the transverse housing of the training device between the shoulder blades.

6 Claims, 10 Drawing Sheets

GOLF TRAINING DEVICE

BACKGROUND

1. Field

Golf training and practice devices.

2. Background

An object of the game of golf is to play a specific number of "holes" in the fewest number of "strokes," each hole ending with a circular "cup" 108 millimeters (mm) in diameter and sunken into the ground at least 100 mm. The hole is found on a specially prepared surface known as a "green."

A recognized fundamental necessary for achievement in the proper play of the game of golf is the golfer's ability to effectively roll the golf ball toward the golf hole once on the green. To do so, the golfer uses a shafted club known as a putter consisting of a "head" on one end and a "grip" on the other. The head and the grip are connected by a shaft with the grip disposed over a portion of the shaft. The grip typically has a hole in the butt end known as a "bleeder hole" which allows air to escape when the grip is affixed to the shaft. The head is typically flat or slightly rounded on the forward surface which allows for an accurate roll of a ball off the "face" of the head.

In order to reduce the number of strokes, the golfer takes on the green, many techniques have been developed and implemented as well as a multitude of design variations in putter head size and shape. It is, however, widely recognized that one of the most important fundamentals in the technique utilized in putting is the golfer's ability to maintain and repeat a simple pendulum-like movement or "stroke" in which the arms remain in a static position and rotate in cohesion with the shoulders which turn about the spine as a unit independent of the head and body. This position has become widely known as the "triangle" between the shoulders and the arms as the hands hold the putter grip. The golfer's ability to maintain the "triangle" throughout the stroke of the ball toward the hole is paramount in achieving putting success as the large shoulder muscles are much more controllable than are the more impulse sensitive muscles of the forearms and the hands.

Many golfers, in an effort to develop the pendulum putting stroke, experience difficulty maintaining the proper stable relationship between their arms, wrists and hands during the putting stroke. This inability to master the proper stroke leads to an inconsistent putter path which does not impact the golf ball consistently and which manifests itself in higher than desired scores.

SUMMARY

In one embodiment, a golf training device is disclosed. The training device attaches to a standard golf putter and enforces a "triangle" position between the hands, arms and shoulders through a pendulum-like putting stroke. In this manner, the training device stabilizes the upper arms and wrists of a golfer and inhibits unwanted and undesirable additional movement therein. Representatively, the training device includes an adjustable transverse housing that is secured between the upper arms or biceps of a golfer by a pair of U-shaped cups that are attached to the transverse housing by telescoping dowels or plungers. A shaft extends from the transverse housing and may be connected to a shaft of a putter through a bleeder hole in a grip of the putter.

When properly installed, the putting training device encourages the correct positioning of the arms, wrists and hands of a golfer in static relation to the putter regardless of the particular physical attributes of the golfer through variable spatial and angular adjustments. Continued use of the training device in practice develops in the golfer a "muscle memory" that can enhance the golfer's ability to repeat the optimal putting stroke for success in the game of golf.

Additional features, embodiments, and benefits will be evident in view of the figures and detailed description presented herein.

BRIEF DESCRIPTION OF THE DRAWINGS

Features, aspects, and advantages of embodiments will become more thoroughly apparent from the following detailed description, appended claims, and accompanying drawings in which:

DETAILED DESCRIPTION

Figure 1:
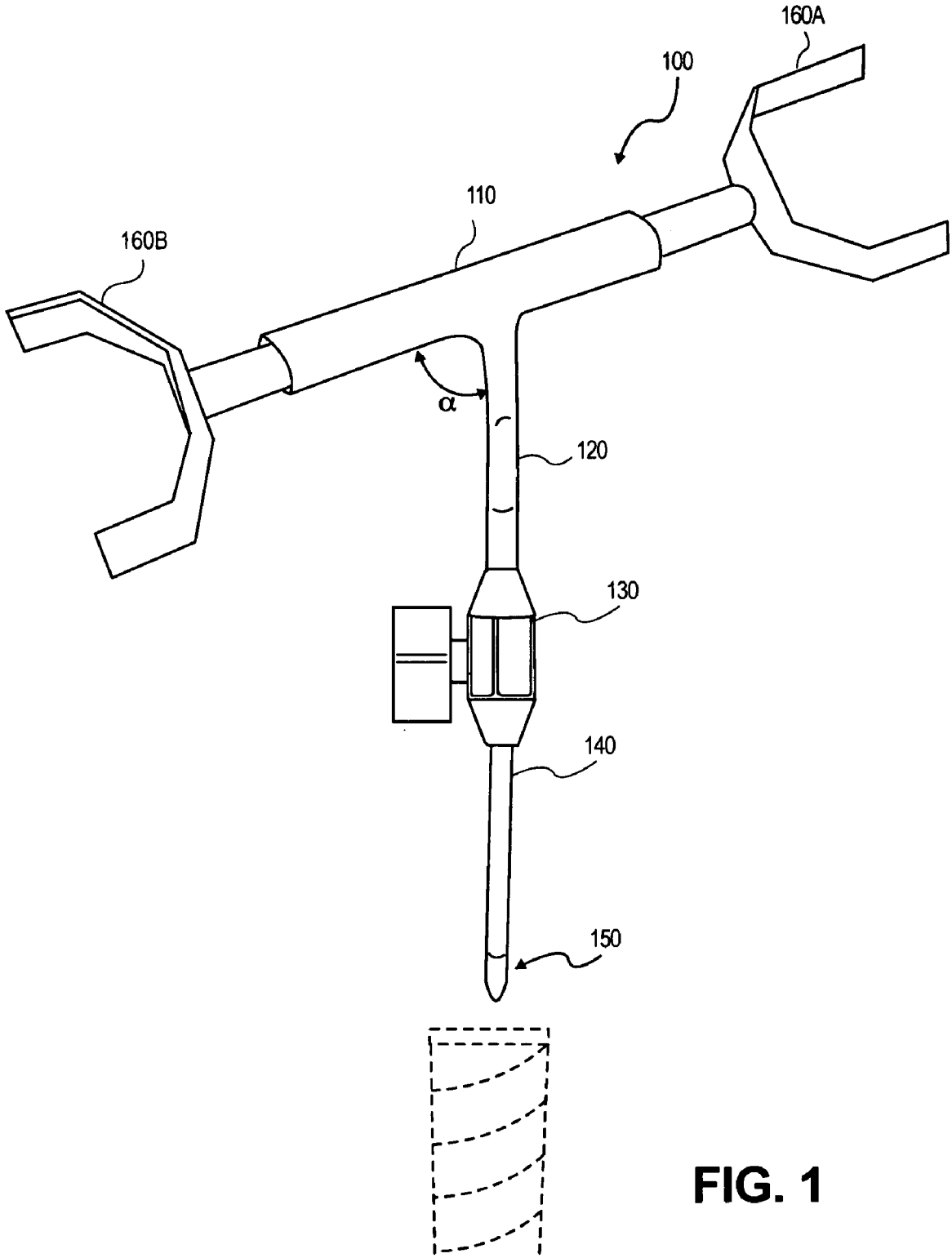
FIG. 1 shows a front perspective view on an embodiment of a golf training device.

FIG. 1 illustrates a front perspective view of an embodiment of a putting practice or training device. Training device 100 includes transverse housing 110, proximal descending shaft 120 and distal descending shaft 140. Distal descending shaft 140 is connected to proximal descending shaft 120 through positioning hinge 130. Distal descending shaft 140 includes distal end 150 that is sized to fit within a bleeder hole of a golf club, particularly a putter. Transverse housing 110 is generally linear structure having two opposing ends. Connected at each end of transverse housing 110 is U-shaped arm cup 160A and U-shaped arm cup 160B, respectively.

FIG. 1 shows training device 100 oriented to be positioned through a bleeder hole of a golf club such as a putter. As shown, distal descending shaft 140 has a generally linear length dimension. Distal descending shaft 140 and proximal descending shaft 120 are illustrated as generally linearly aligned relative to transverse housing 110. A junction between transverse housing 110 and proximal descending shaft 120 defines an angle $\alpha$ that, in this embodiment, is less than 90° (e.g., 70° to 80°). As will be illustrated later, transverse housing 110 is generally intended to be parallel to a line between the shoulder blades of a golfer as the golfer grips a handle of the golf club with training device installed therein. According to a conventional golf grip for a right handed golfer, the right hand is lower on the grip than the left hand. In such situation, the right shoulder will be dipped relative to the left shoulder. The angle $\alpha$ corresponds, in one embodiment, to the dipping in this instance of the right shoulder blade below the left shoulder blade. The angle $\alpha$ at the junction between transverse housing 110 and proximal descending shaft 120 also tends to render proximal descending shaft 120 perpendicular to a horizontal plane (e.g., the ground) when transverse housing 110 is engaged by the biceps of a golfer and the hands of the golfer extend to grasp a golf club in a stacked configuration (e.g., right hand below left hand). It is appreciated that for a left-handed golfer or an individual who prefers to place his/her left hand below the right hand in the putting grip, an embodiment will have angle $\alpha$ greater than 90°.

Figure 2:
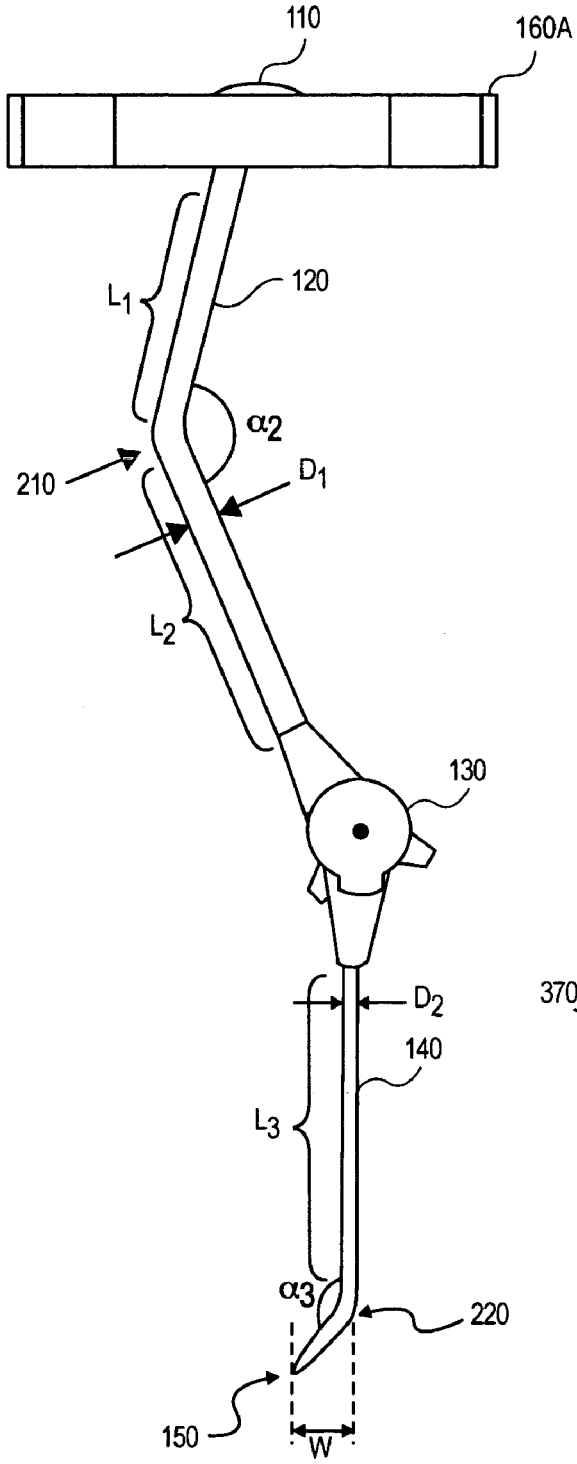
FIG. 2 shows a left side view of the golf training device of FIG. 1.

FIG. 2 shows a left side view of the training device of FIG. 1. FIG. 2 shows proximal descending shaft 120 having a first length portion L1 and a second length portion L2. In one embodiment, first length portion L1 and second length portion L2 total approximately eight inches. First length portion L1 and second length portion L2 define offset bend 210 having an angle, $\alpha_2$, of approximately 120° to 140°, in one embodiment, approximately, 130°. Proximal descending shaft 120 is, for example, a metal material, such as aluminum or steel. In one embodiment, proximal descending shaft 120 is a solid metal material having a diameter on the order of 0.31 inches. A proximal end of proximal descending shaft 120 is connected to transverse housing 110 by, for example, a weld, solder or epoxy.

In one embodiment, distal descending shaft 140 has a length, L3, on the order of about four inches. In one embodiment, distal descending shaft 140 is a solid material, such as a solid metal. A representative diameter for distal descending shaft 140 is on the order of 0.25 inches. Distal descending shaft 140 includes distal end 150 that may have a tapered tip to facilitate the insertion of distal end 150 and a portion of distal descending shaft 140 into a bleeder hole of a golf club, particularly, a putter. In one embodiment, distal end 150 is offset by an angle of $\alpha_3$, opposite angle $\alpha_2$. In one embodiment, $\alpha_3$ is selected such that a width between distal end 150 and bend point 220 define a width, W, equivalent to the inside diameter of a shaft of a golf club, particularly, a putter. A representative width, W, is on the order of 0.75 inches in the top three inches of a standard putter.

Figure 3:
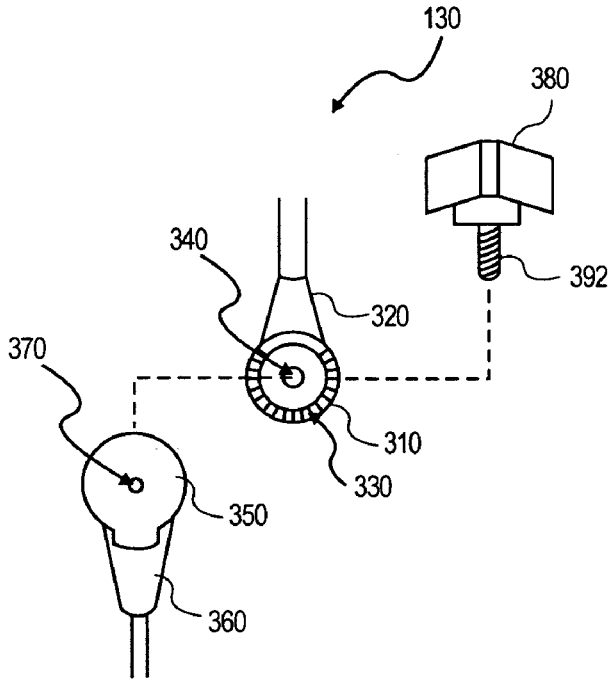
FIG. 3 shows an exploded side view of a hinge portion of the golf training device of FIG. 1.

FIG. 3 shows a portion of proximal descending shaft 120 and a portion of distal descending shaft 140 in an exploded configuration at positioning hinge 130. As shown, positioning hinge 130 includes first circular portion 310 connected at a distal end of proximal descending shaft 120 to hub 320. First circular portion 310 includes a generally planar surface having a plurality of teeth or ridges around a perimeter. First circular portion 310 defines hole 340 in a center thereof. Positioning hinge 130 also includes second circular portion 350 connected to a proximal end of distal descending shaft 140 through hub 360. In one embodiment, a diameter of second circular portion 350 is similar to a diameter of first circular portion 310. Second circular portion 350 has a generally planar surface with at least some teeth or ridges around a parameter, perhaps in groups of ridges or teeth not surrounding the entire perimeter. Second circular portion 350 defines hole 370 through a center thereof. In one embodiment, at least one of hole 340 (in first circular portion 310) and hole 370 (in second circular portion 350) is threaded. Positioning hinge 130 also includes handle 380 having threaded portion 390 extending therefrom. Threaded portion 390, in one embodiment, is configured to mate with a threaded portion in either or both of hole 340 and hole 370.

When assembled, positioning hinge 130 allows distal descending shaft 140 to pivot approximately 180° from perpendicular to a distal end of proximal descending shaft 120. Tightening handle 380 causes mating teeth in first circular portion 310 and second circular portion 350 to engage and hold distal descending shaft 140 at the angle selected.

FIGS. 4–10 illustrate an embodiment of a U-shaped arm cup or sleeve connecting with transverse housing 110. In one embodiment, transverse housing 110 is a tubular material, such as aluminum or steel. A representative diameter of the lumen or bore of transverse housing 110 is on the order of 0.6 inches. Transverse housing 110 has a length that will fit between the biceps of a golfer. A representative length is approximately seven inches.

Figure 4:
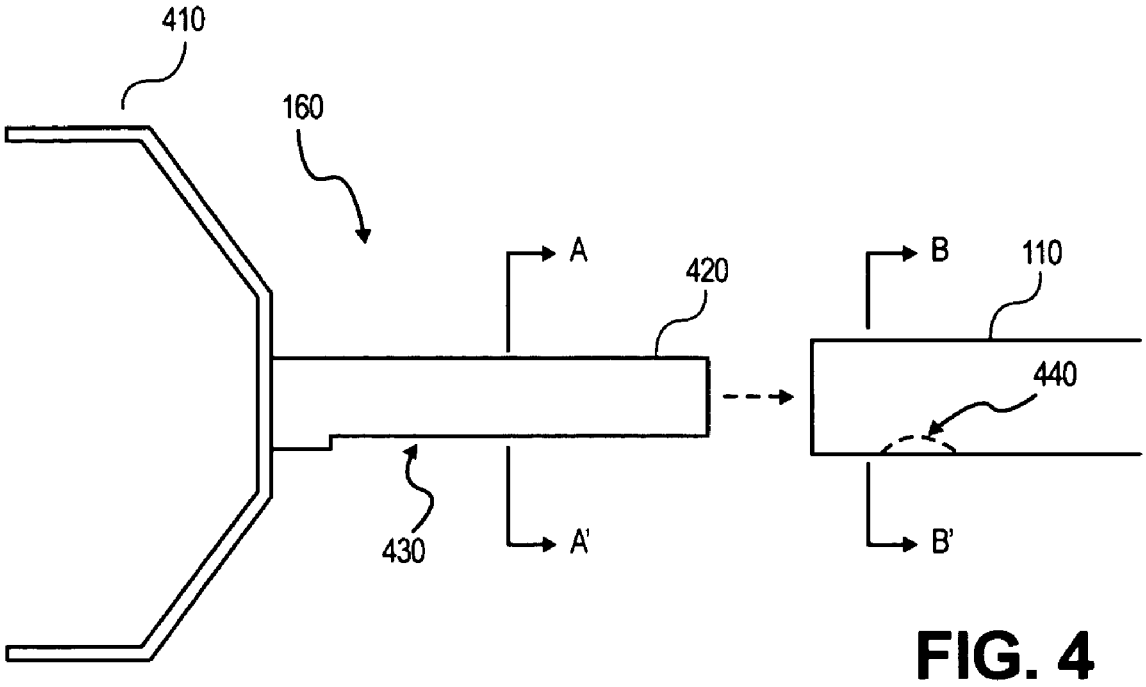
FIG. 4 shows an exploded side view of an arm cup and portion of a transverse housing of the golf training device of FIG. 1.

FIG. 4 also shows arm cup 160A including U-shaped portion 410 and telescoping plunger or dowel 420 connected to a base of U-shaped portion 410 (e.g., a side opposite a side defining an area encompassed by U-shaped portion 410). U-shaped portion 410 has a diameter suitable to accommodate a portion of a bicep of a golfer. A representative diameter of U-shaped portion 410 is on the order of about four inches. Plunger 420 has a representative length on the order of three to four inches. In one embodiment, arm cup 160A is a one piece plastic material including U-shaped portion 410 and plunger 420. Representatively, a one piece plastic material may be made by injection molding techniques.

Figure 5:
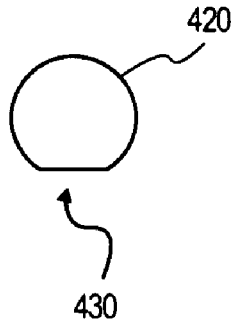
FIG. 5 shows a cross-sectional side view through line A–A' of FIG. 4.

Plunger 420 is sized to fit within the lumen of transverse housing 110. In one embodiment, plunger 420 has a generally circular shape having a diameter slightly smaller than a diameter of the lumen of transverse housing 110. In the example where a lumen of transverse housing 110 has a diameter of approximately 0.6 inches, plunger 420 may have a diameter on the order of 0.5 inches. Plunger 420 is generally circular and includes flatted portion 430 that representatively reduces the diameter of plunger 420 by approximately one-tenth of an inch. FIG. 5 shows a cross-sectional side view through line A–A' of arm cup 160A of FIG. 4. In one embodiment, flatted portion 430 extends the length of plunger 420. In the embodiment shown in FIG. 4, flatted portion 430 begins away from the junction of plunger 420 and U-shaped portion 410 and extends to a distal end of plunger 420.

Referring again to FIG. 4, transverse housing 110 includes indentation 440 protruding into the lumen of transverse housing 110. In one embodiment, indentation 440 is a dimple placed on the exterior surface of transverse housing 110. Indentation 440 protrudes into the inner diameter of transverse housing 110 approximately one-tenth of an inch or more. In one embodiment, the protrusion of indentation 440 minimizes the diameter of the lumen of transverse housing 110 by an amount equivalent to a diameter of plunger 420 of arm cup 160A including flatted portion 430. In other words, a portion of plunger 420 including flatted portion 430 may fit within transverse housing 110 at indentation 440 but a portion of plunger 420 not including flatted portion 430 would not fit within the same diameter.

Figure 7:
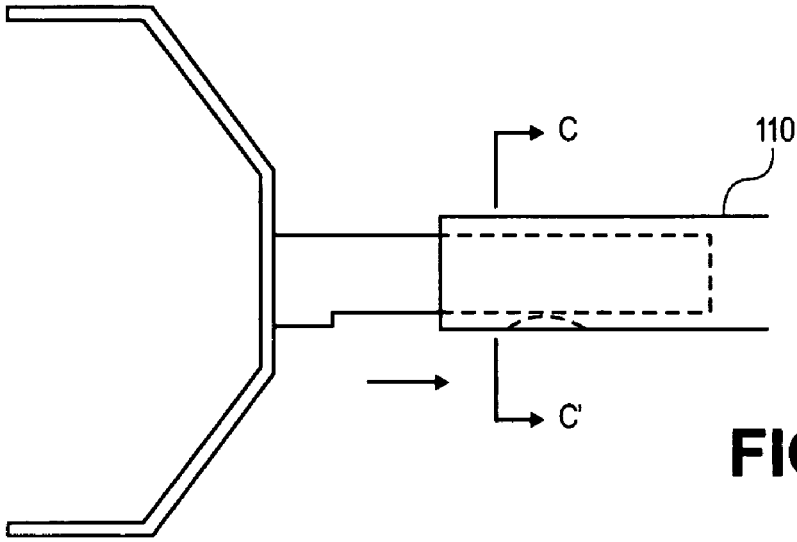
FIG. 7 shows the arm cup positioned according to a first orientation within the transverse housing of the golf training device of FIG. 1.
Figure 9:
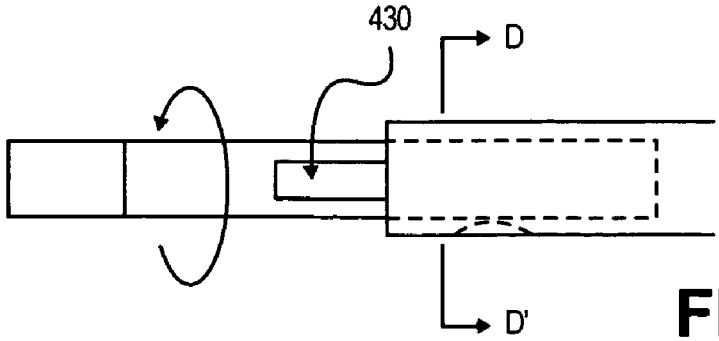
FIG. 9 show the arm cup positioned according to a second orientation within the transverse housing of the golf training device of FIG. 1.
Figure 6:
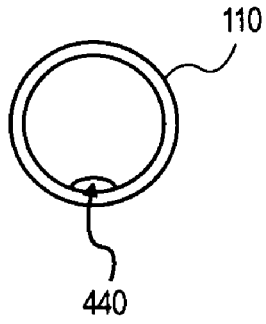
FIG. 6 shows a cross-sectional side view through line B–B' of FIG. 5.
Figure 8:
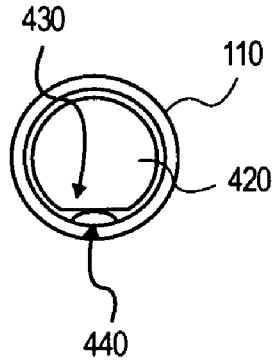
FIG. 8 shows a cross-sectional side view through line C–C' of FIG. 7.
Figure 10:
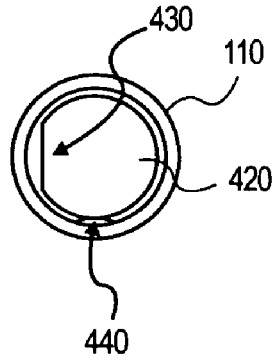
FIG. 10 shows a cross-sectional side view through line D–D' of FIG. 9.

FIG. 6 shows a cross-sectional side view through line B–B' of transverse housing 110 of FIG. 4 and shows indentation 440 within a lumen of transverse housing 110. Thus, FIG. 7 shows arm cup 160A inserted into the lumen of transverse housing 110 with flatted portion 430 aligned with indentation 440. According to this embodiment, plunger 420 may be inserted a variable distance selected, in one embodiment, to coincide with a desired separation between transverse housing 110 and a bicep of golfer using training device 100. FIG. 8 shows a cross-sectional side view through line C–C' of FIG. 7 with flatted portion 430 of plunger 420 aligned with indentation 440 of transverse housing 110. Once any particular depth is determined by a user (golfer) of training device 100, arm cup 160A may be rotated approximately 45° to lock plunger 420 at a desired position. FIG. 9 shows arm cup 160A after a rotation of approximately 45°. FIG. 10 shows a cross-sectional side view through line D–D'. As shown in FIG. 10, a rounded portion of a circumference of plunger 420 at indentation is in contact with indentation 440 and other portions of the circumference of plunger 420 (e.g., opposite indentation 440) contact an inner wall of transverse housing 110 to secure arm cup 160A within transverse housing 110. A similar operation may be performed with respect to arm cup 160B.

Figure 11:
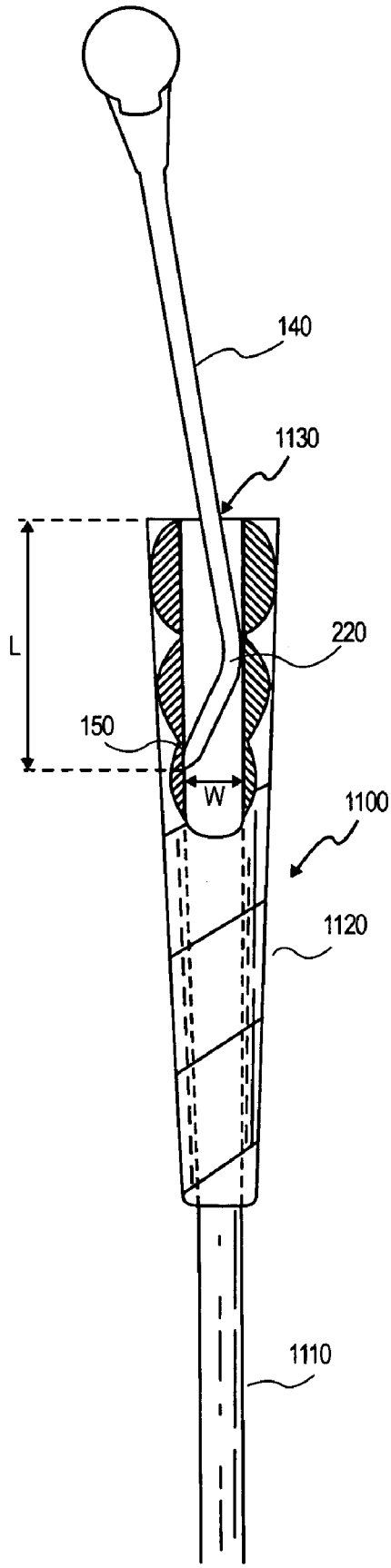
FIG. 11 shows a portion of a descending shaft of the golf training device of FIG. 1 extending into a golf club shaft with a partial cut-away view of the shaft.

FIG. 11 shows distal descending shaft 140 inserted into a shaft of a golf club, particularly a putter. FIG. 11 shows a cross-sectional side view of a portion of the putter. Referring to FIG. 11, putter 1100 includes shaft 1110 having grip 1120 at one end of the shaft. A proximal end of grip 1120 includes bleeder hole 1130. Distal descending shaft 140 is placed so that distal end 150 extends through bleeder hole 1130 and is advanced until the edge of distal descending shaft 140 contacts a side wall of shaft 1110 at bend portion 220. Since a distance or width, W, between distal end 150 and bend portion 220 of distal descending shaft 140 is equivalent to a width of shaft 1110, distal end 150 will contact an opposing side wall of shaft 1110. In this manner, distal descending shaft 140 is secured within shaft 1110. It is appreciated that a shaft diameter may taper gradually from a proximal end of the shaft to a distal end near the club head. In one embodiment, distal descending shaft 140 extends approximately 2.75 inches into shaft 1110 of putter 1100 to secure distal descending shaft 140 to shaft 1110.

Figure 12:
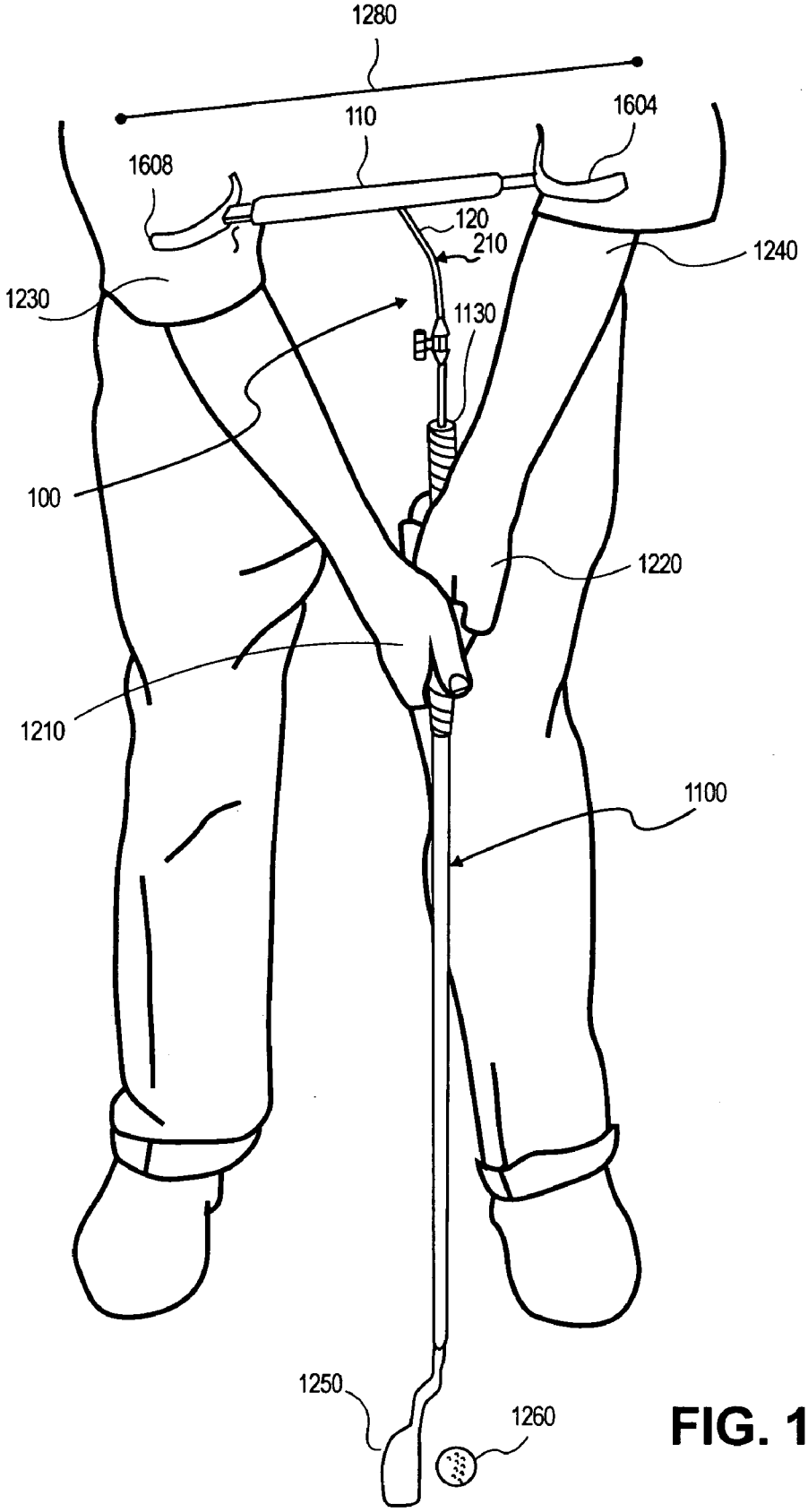
FIG. 12 shows a front view of a golfer addressing a golf ball and the golf training device of FIG. 1 engaged by the biceps of the golfer and connected to the shaft of a golf club.

FIG. 12 shows training device 100 installed through a bleeder hole of a golf club, particularly, a putter. FIG. 12 also shows a golfer assuming a putting stance. In this stance, a golfer positions his/her right hand 1210 below his/her left hand 1220. Training device 100 is positioned such that transverse housing 110 extends between right bicep 1230 and left bicep 1240 of the golfer. The particular position of training device 100 relative to the biceps is established by positioning arm cups 160A and 160B such that the arm cups contact right bicep 1230 and left bicep 1240, respectively. FIG. 12 shows the golfer aligned such that head 1250 of putter 1100 is positioned behind golf ball 1260. In this position, the right shoulder blade of the golfer is lower than the left shoulder blade. In one embodiment, transverse housing 110 is parallel to line 1280 extending between the shoulder blade.

Using the golfer's body as a reference point, in the embodiment shown in FIG. 12, offset bend 210 of proximal descending shaft 120 extends forward (toward the toes of the golfer). Bend point 220 of distal descending shaft 140, on the other hand, extends back so that distal end 160 similarly extends forward. It is appreciated that the selected position may vary, principally, through adjustment of positioning hinge 130.

Figure 13:
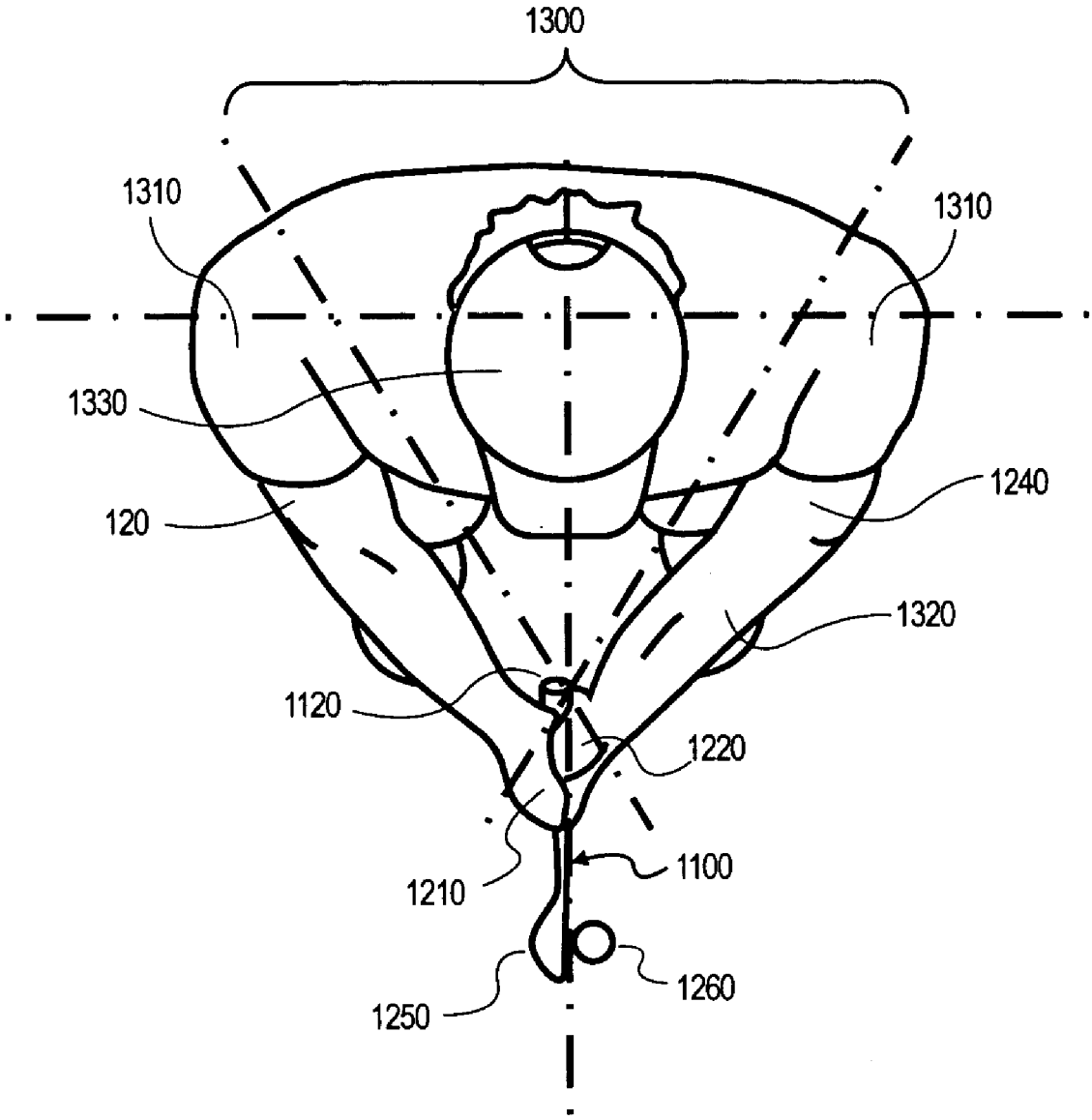
FIG. 13 shows a top view of a golfer addresses a golf ball and illustrates a preferred "triangle" orientation of shoulders, arms and hands.

FIG. 13 shows a top view of a golfer in a putting position grasping a putter and addressing a golf ball. FIG. 13 illustrates a geometric diagram of angular orientation 1300 of the golfer's shoulder 1310, upper arms or biceps 1230 and 1240 and forearms 1320 as they extend downward toward grip 1120 of putter 1100. This "triangle" orientation is a preferred putting stance. Grip 1120 is grasped by right hand 1210 and left hand 1220 with, in this configuration, right hand 1210 below left hand 1220. FIG. 13 shows a triangle formed between the golfer's shoulders 1310 and the golfer's grip. The shaft of putter 1100 biceps the triangle approximately in the center of the golfer's head 1330.

Figure 14:
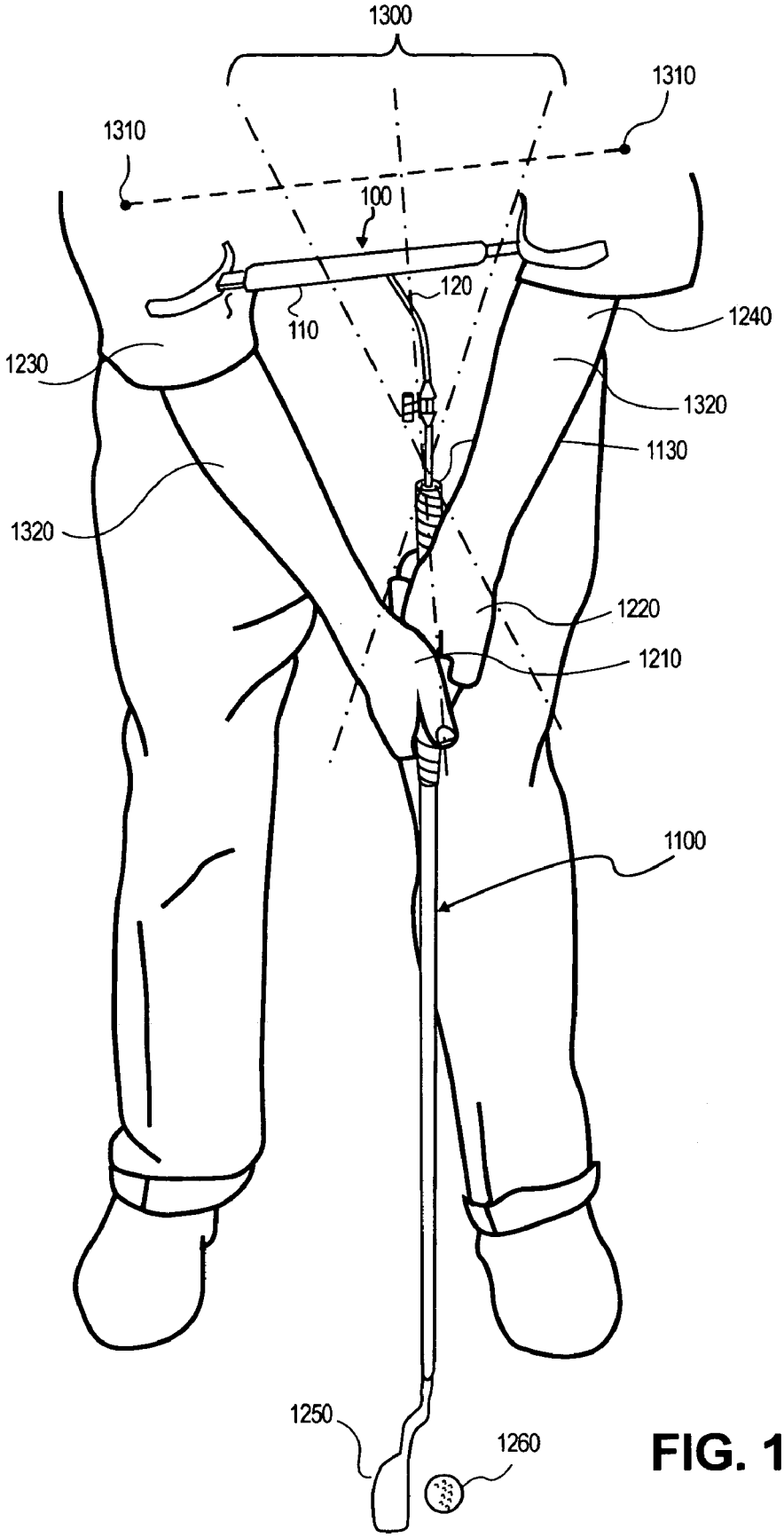
FIG. 14 shows a front view of a golfer addressing a golf ball and the golf training device of FIG. 1 engaged by the biceps of the golfer and connected to the shaft of a golf club and illustrates the "triangle" orientation.

FIG. 14 shows a front view of a golfer in a putting stance addressing the golf ball as in FIG. 13. FIG. 14 shows training device 100 connected to putter 1100. FIG. 14 also shows a geometric diagram illustrating angular orientation of the golfer's shoulders 1310, upper arms or biceps 1230 and 1240 and forearms 1320 as the forearms extend downward to putter grip 1120. Training device 100 is positioned between the golfer's right biceps 1230 and left biceps 1240. Training device 100 is also connected to putter 1100 through the insertion of distal descending shaft 140 into bleeder hole 1130 of putter 1100. FIG. 14 shows that through the use of training device 100, angular orientation 1300 (the "triangle") is established.

Figure 15:
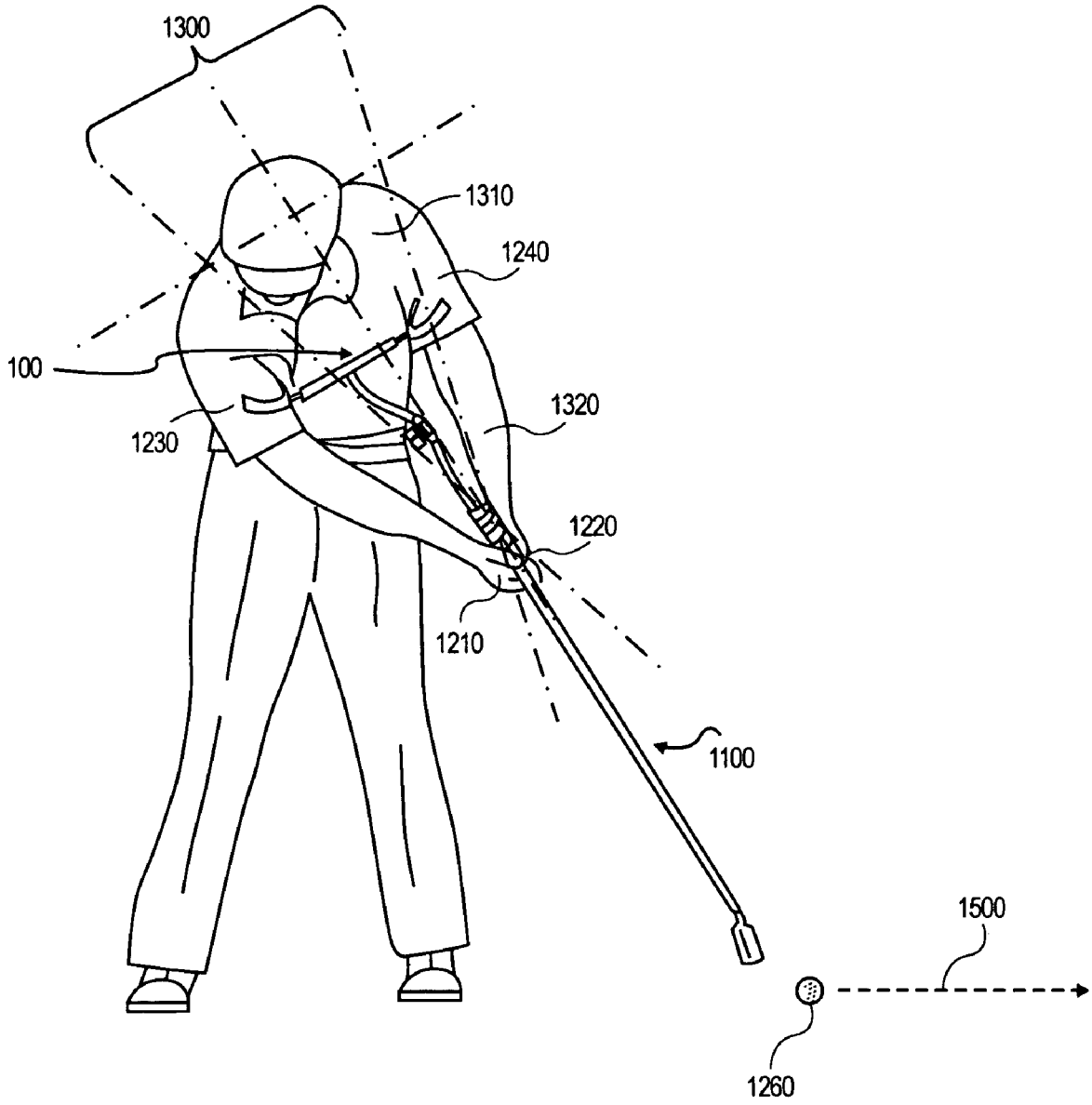
FIG. 15 shows a front view of a golfer at the conclusion of a putting stroke and the golf training device of FIG. 1 engaged by the biceps of the golfer and connected to the shaft of a golf club and illustrates the "triangle" orientation.

FIG. 15 is a frontal view of a golfer as the golfer completes a putting stroke. FIG. 15 illustrates training device 100 assisting golfer to maintain angular orientation 1300 between shoulders 1310, right and left biceps 1230 and 1240, forearms 1320, and right hand 1210 and left hand 1220 throughout the putting stroke. Maintaining angular orientation 1300 from the point of addressing the ball to completing a putting stroke tends to improve the likelihood of striking ball 1260 consistently and accurately (e.g., to make ball 1260 proceed in its intended path 1500). Training device 100 assists in maintaining angular orientation 1300.

Figure 16:
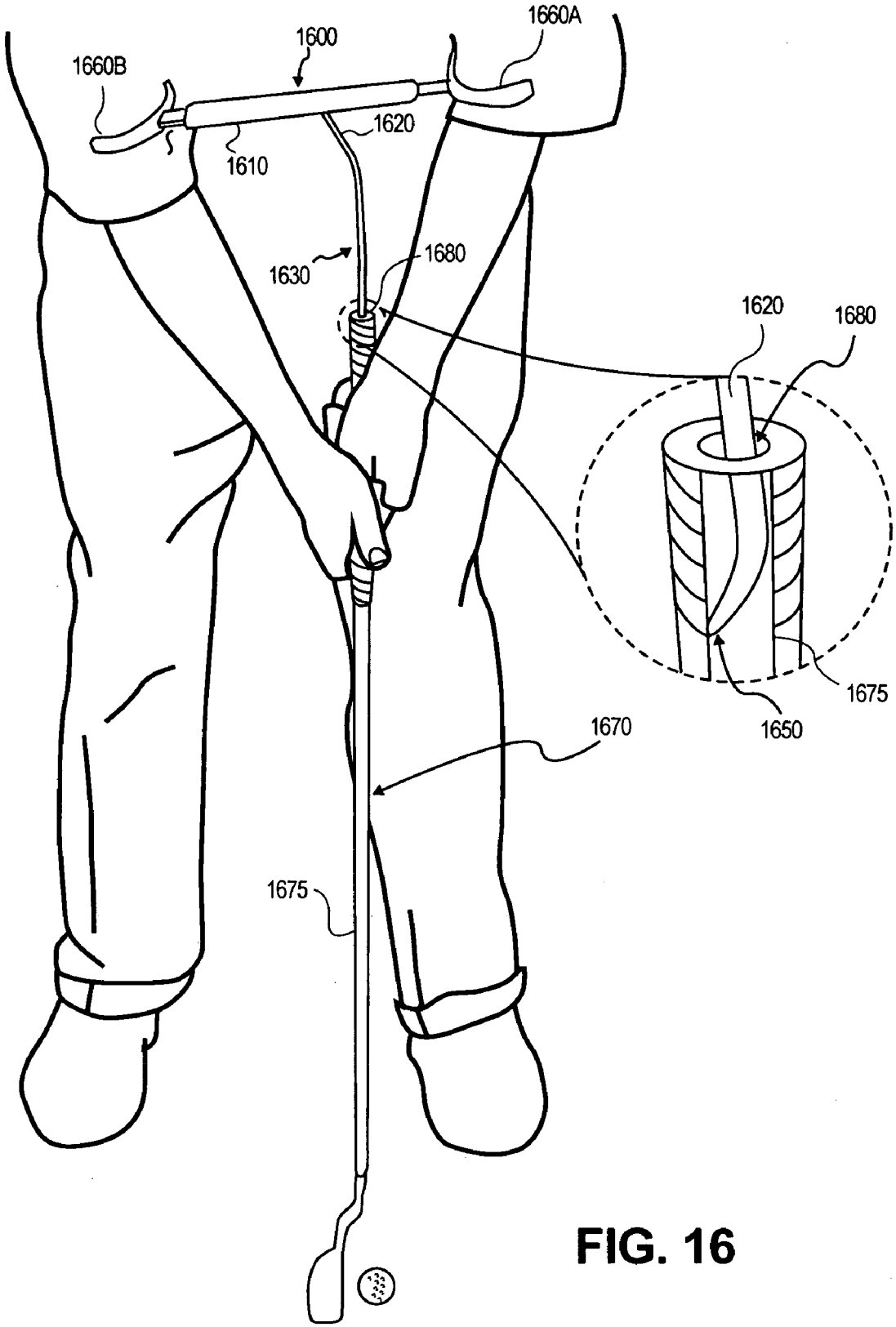
FIG. 16 shows a front view of a golfer addressing a golf ball and another embodiment of a golf training device engaged by the biceps of the golfer and connected to the shaft of a golf club.

FIG. 16 shows another embodiment of a training device. FIG. 16 shows the embodiment of the training device connected to a putter and a golfer addressing a golf ball with the putter. Referring to FIG. 16, training device 1600 includes space maintaining housing 1610 and left arm cup 1660A extending from one side and right arm cup 1660B extending from an opposite side thereof. The arm cups and the positioning of the arm cups within space maintaining housing 1610 may be similar to that described above with reference to FIG. 1 and FIGS. 4–10.

Training device 1600 also includes descending shaft 1620. In this embodiment, descending shaft 1620 is a single-piece shaft having a tapered distal end 1650 sized to fit within a bleeder hole of a golf club, particularly, a putter. An inset of FIG. 16 shows a distal portion of descending shaft 1620 inserted through bleeder hole 1680 of a grip of golf club 1670 (e.g., perpendicular to the ground). The inset also shows descending shaft 1620 having an angled distal portion to contact side walls of shaft 1675 of golf club 1670. The connection of descending shaft 1620 to shaft 1675 of golf club 1670 is similar, in this embodiment, to the connection described above with reference to FIG. 11 and the accompanying text.

As described, descending shaft 1620 is a single-piece material. Descending shaft 1620 includes, in one embodiment, offset bend 1630, proximal and distal portion of descending shaft 1620. In one embodiment, offset bend 1630 is bent to an angle such that the distal portion of descending shaft 1620 is approximately parallel to shaft 1675 of golf club 1670. Descending shaft 1620 may made from a material that is flexible enough to be bent by human force, but rigid enough to hold its shape and remain in place while in use. Representative materials include aluminum and steel. In this manner, descending shaft 1620 may be manipulated to suit a comfortable position for a particular golfer.

In one embodiment, it is intended that a golfer will practice his/her putting strokes using a training device such as described. The golfer can install a training device into his/her putter and practice putting on, for example, a practice green. The embodiments of a training device described above assist in maintaining a particular angular orientation, e.g., through a pendulum-like movement or stroke. During the pendulum-like movement, the training device helps to maintain a golfer's arms, wrists and hands in a generally static position and rotate in cohesion with the shoulder which turn about the spine as a unit independent of the head and body. This establishment of a "triangle" between the shoulders and arms as the hands of the golfer holds the putter grip and pendulum motion of the putting stroke should produce more consistent striking of the golf ball and directing of a ball along its intended path. Repeated use of the training device will reinforce the desired or the intended muscle movement of the pendulum so that when a golfer putts without the training device, the golfer will repeat the movement.

In the preceding detailed description, reference is made to specific embodiments thereof. It will, however, be evident that various modifications and changes may be made thereto without departing from the broader spirit and scope of the following claims. The specification and drawings are, accordingly, to be regarded in an illustrative rather than a restrictive sense.

What is claimed is:

1. An apparatus comprising:

a transverse housing having a length sized to fit between the biceps of a human; and a descending shaft coupled to and bisecting the transverse housing, the shaft comprising:

a length suitable to extend from the transverse housing to a shaft of a golf club when a human assumes an addressing stance and the transverse housing is engaged at a position between the biceps of the human; and a distal portion having a dimension suitable to fit within a bleeder hole of a golf club grip and comprising a bend portion and an end, wherein the bend portion of the shaft defines an apex and a distance between parallel lines projected at the end and the apex of the bend portion, respectively, has a width equivalent to an interior diameter of a shaft of a golf club at a grip portion.

2. The apparatus of claim 1, further comprising a pair of U-shaped cups coupled to the transverse housing and extending from respective ends thereof, each of the pair of U-shaped cups having a diameter suitable to engage a portion of a human bicep.

3. The apparatus of claim 2, wherein the transverse housing comprises end portions having a tubular structure each defining a lumen and each of the pair of U-shaped cups comprise a telescoping plunger coupled to a base thereof, the plunger having a diameter sized to fit within the lumen of the transverse housing.

4. The apparatus of claim 1, wherein an angle at which the descending shaft is coupled to the transverse housing renders a portion of the descending shaft perpendicular to a horizontal plane when the transverse housing is engaged by the biceps of a human and the hands of the human extend to grasp a golf club in a stacked configuration.

5. The apparatus of claim 1, wherein the descending shaft comprises a proximal portion and a distal portion and the proximal portion is connected to the distal portion through a hinge.

6. The apparatus of claim 5, wherein the hinge provides a plurality of adjustment positions of the distal portion relative to the proximal portion.

* * * * *